United States Patent [19]

Wittmann et al.

[11] 4,436,322

[45] Mar. 13, 1984

[54] LOCKING MECHANISM

[75] Inventors: Heinz Wittmann; Vladimir Konwitza, both of Vienna, Austria

[73] Assignee: TMC Corporation, Baar, Switzerland

[21] Appl. No.: 315,393

[22] Filed: Oct. 27, 1981

[30] Foreign Application Priority Data

Oct. 28, 1980 [AT] Austria ..... 5303/80
Feb. 4, 1981 [AT] Austria ..... 501/81

[51] Int. Cl.[3] ..... A63C 9/08
[52] U.S. Cl. ..... 280/614; 280/618
[58] Field of Search ..... 280/611, 614, 615, 618, 280/617

[56] References Cited

U.S. PATENT DOCUMENTS 4,088,342 5/1978 Hausleithner ..... 280/614
4,088,343 5/1978 Krob ..... 280/625
4,322,090 3/1982 Loughney ..... 280/614

FOREIGN PATENT DOCUMENTS 280115 3/1970 Austria .
297550 3/1972 Austria .
351979 8/1979 Austria .
355473 3/1980 Austria .
35951 9/1981 European Pat. Off. ..... 280/614
2394311 2/1979 France ..... 280/614

*Primary Examiner*—Joseph F. Peters, Jr.
*Assistant Examiner*—Michael Mar
*Attorney, Agent, or Firm*—Flynn, Thiel, Boutell & Tanis

[57] ABSTRACT

A locking mechanism for a safety ski binding for cross-country skiing and for downhill skiing, namely a so-called cross-country skiing binding. A cross-country plate is provided for carrying in its rear area a heel holder. A bearing block is provided on the heel holder and swingably supports a two-arm release lever. A locking element is arranged on the ski, which locking element can be locked to or unlocked from the cross-country plate by the release lever and permits an adjustment of the cross-country binding to the different ski shoe lengths. The locking element is constructed as a slide piece which is movably guided on a ski-fixed rail, which slide piece moves in a channel in the cross-country plate and can be engaged with or disengaged from a slide member which is movably guided on the edge of the channel by means of the release lever which can be operated preferably manually.

14 Claims, 16 Drawing Figures

LOCKING MECHANISM

FIELD OF THE INVENTION

The invention relates to a locking mechanism for a safety ski binding for cross-country skiing and for downhill skiing, namely for a so-called cross-country binding with a cross-country plate which carries adjacent its rear region a heel holder, on which heel holder is a locking mechanism having a two-arm release lever pivotally mounted on a bearing block which is fixed on the cross-country plate, which locking mechanism has a locking element which is arranged on the ski and which can be locked with or unlocked from the cross-country plate and permits an adjustment of the cross-country binding to different ski shoe lengths.

BACKGROUND OF THE INVENTION

A locking mechanism of the abovementioned type is described for example in Austrian Patent No. 351 979. A holding bar is secured in this conventional mechanism to the upper side of the ski on both sides of the cross-country plate. Small plates are provided on the cross-country plate, which small plates have sloped grooves, into which engage pegs of an operating slide member. By moving the operating slide member in longitudinal direction of the ski, the small plates can be moved under the holding bar. A further embodiment provides cam plates lying in recesses of the cross-country plate and can be engaged with or disengaged from the holding bars by means of operating flaps through rotation. In these conventional embodiments, however, it is disadvantageous for the skier to have to step out of the cross-country binding as soon as he wants to unlock the cross-country plate for cross-country skiing or wants to lock same for the downhill skiing. Also it has been proven in practice that for operating the operating flaps a special tool is required since these can be swung manually only through the exertion of a large amount of force.

SUMMARY OF THE INVENTION

Therefore the purpose of the invention is to provide locking mechanism of the abovementioned type in such a manner that it does not have the disadvantages of the conventional designs, that for locking or unlocking a stepping out of the binding is not required and that the operation can be done manually in the simplest manner and practically without any appreciable exertion of force.

The objects and purposes inventively attained by a locking element which is arranged on the ski being constructed as a slide piece which is movably quided on a rail fixed to the ski, which slide piece extends through a recess in the cross-country plate and can be engaged with or disengaged from a slide member which is guided movably at the edge of the recess by means of a lever which can be operated preferably manually.

The objects and purposes are satisfactorily achieved with the inventive measures. The locking elements of the locking mechanism are arranged below the heel holder or on the heel holder, the mechanism itself has few structural parts and can be operated manually by means of a lever. For locking and unlocking of the cross-country binding on or from the ski, one must not step out of the binding.

An important thought of the invention consists in a slide piece having a groove which extends parallel with respect to the upper side of the ski and which is open in a direction toward the tail of the ski, into which groove is received or from which groove is removed a pin which connects two holding parts of the slide member, wherein the holding parts of the slide member can be moved on guide shoulders on the edge of the recess, which shoulders extend parallel with respect to the longitudinal axis of the ski. Thus the entire locking mechanism has no projecting, annoying parts, which could interfere primarily in the downhill skiing position of the cross-country binding.

This is inventively achieved also when the slide piece has on each of its two side areas which extend parallel with respect to the longitudinal axis of the ski a guide part which is offset from the remaining side area, wherein each guide part has a rabbet which divides the guide part and which extends parallel with respect to the upper side of the ski, locking arms of the slide member being able to be engaged with and disengaged from the rabbets, which slide member is constructed in two parts and is movably guided in guide grooves which extend parallel with respect to the upper side of the cross-country plate and are constructed on the two inner walls of the bearing block.

A further advantage of this inventive construction consists in the upper side of the slide piece being constructed as a sloped surface which drops off in a direction toward the tail of the ski, over which sloped surface in cooperation with a binding part it is possible during the cross-country skiing to guide snow and ice accumulations away from the locking area. In this manner the snow which accumulates during the up and down movement of the cross-country plate is squeezed out of the binding and locking area during each setting down of the cross-country plate onto the upper side of the ski. The risk of ice and snow accumulations in the locking area, which risk exists primarily during soft, sticky snow, through which the functioning capability of the entire locking mechanism could be influenced unfavorably, is prevented in the simplest manner and the locking elements remain fully functional. Since the slide piece cooperates with an already existing binding part, no additional structural parts are needed.

Therefore, an important concept of the invention is seen in the binding part being a substantially closed sole engaging piece which is supported on the bearing block of the heel holder, the lower area of which piece faces the upper side of the ski and extends in the downhill skiing position of the cross-country binding, viewed from the end area of the slide piece, which lies higher relative to the upper side of the ski, at least up to half preferably up to two thirds of the sloped surface of the slide piece. This measure assures an effective guiding away of the snow during each setting down of the cross-country plate onto the upper side of the ski.

In order for the wedge effect, which occurs between the underside of the housing and the sloped surface of the slide piece, to become particularly effective, it is provided according to the invention that the angle, which exists between the sloped surface of the slide piece and at least the partial area of the underside of the sole engaging piece, which area lies above the end area of the slide piece and the end area lies higher relative to the upper side of the ski, is approximately 10° to 30°.

A further preferable development of the inventive mechanism consists in the lever which is provided for operating the slide member being the release lever which is hinged swingably on the bearing block of the heel holder, the one arm of which release lever projects into the area of movement of the slide member and has a bolt thereon receivable in a locking recess provided on a holding part of the slide member. This embodiment is particularly preferable in that the operation of the locking mechanism occurs by means of a structural part, namely the release lever provided at any rate on the heel holder.

A further type of operation of the locking mechanism occurs inventively by the lever, which is provided for the operation of the slide member, being a ski pole, the tip of which can be inserted through an opening in a projection member on the slide member projecting over the heel holder in a direction toward the tail of the ski. The slide member is supported on a channel of the cross country plate, which channel is arranged on an area of the cross-country plate adjacent the tail of the ski. Also this possibility of movement of the slide member does not require any additional structural parts.

A further characteristic of the invention consists in the free end areas of the rail having stops, for example in the form of screws which are inserted at the end areas of the rail, and a small stop plate being held at the underside of the slide piece, which small stop plate permits a limited longitudinal movement of the slide piece on the rail. Through this, a sliding off of the slide piece from the rail, primarily in the position of the binding for cross-country skiing, is avoided. The small stop plate limits the longitudinal movement of the slide piece on the path which is necessary for a thrust balance of the binding.

An adjustment of the cross-country binding to different ski shoe lengths is inventively assured by the slide piece having an opening, into which a screw can be inserted, which extends through a slotted hole of the small stop plat which slotted hole extends along the longitudinal extent of the rail, wherein the position of the slide piece can be adjusted over the entire length of the slotted hole relative to the small stop plate or relative to the rail and can be fixed by means of a lock nut.

A further, important advantage of the invention consists in at least one slide surface being provided on the bearing block in the area of the channel of the cross-country plate, which slide surface(s) extends at an angle with respect to the underside of the cross-country plate and which are arranged loading either sloped surfaces which are arranged on the slide piece or at least an edge which is rounded and which is provided on the slide piece during a swinging of the cross-country plate in direction toward the upper side of the ski. The slide piece is therefore also grabbed by the recess of the cross-country plate when it is moved on the rail relative to the recess.

BRIEF DESCRIPTION OF THE DRAWINGS

The invention will now be described in greater detail with reference to the drawings which illustrate several exemplary embodiments.

In the drawings:

FIG. 2 is a side view, partially in cross section, of a heel holder of a cross-country binding with the inventive locking mechanism, wherein the dash-dotted lines illustrate the locked position and the full lines illustrate the unlocked position; FIG. 3 as a top view of FIG. 2; and FIG. 4 is a side view of the heel holder with the locking mechanism in its position for cross-country skiing;

FIG. 6 is a cross-sectional side view; FIG. 7 is a cross-sectional view taken along the line VII—VII of FIG. 6; and FIG. 8 is a top view of FIG. 6;

FIGS. 9, 9*a*, 10, 10*a* and 10*b* illustrate a further exemplary embodiment of an inventive locking mechanism, wherein FIG. 9 is a side view, partially in cross section, with the locking mechanism in its position for cross-country skiing; FIG. 9*a* is a side view, partially in cross section, with the locking mechanism in its position for downhill skiing; FIG. 10 is a cross-sectional view of the locking mechanism taken along the line X—X of FIG. 9; FIG. 10*a* is cross-sectional view of the locking mechanism taken along the line Xa—Xa of FIG. 9*a;* FIG. 10*b* is a cross-sectional view of the locking mechanism taken along the line Xb—Xb of FIG. 9*a;*

FIG. 11 is a centrally, longitudinally sectioned side view; FIG. 12 is a cross-sectional view taken along the line XII—XII of FIG. 11; and FIG. 13 is a top view of FIG. 11.

DETAILED DESCRIPTION

Figure 1:
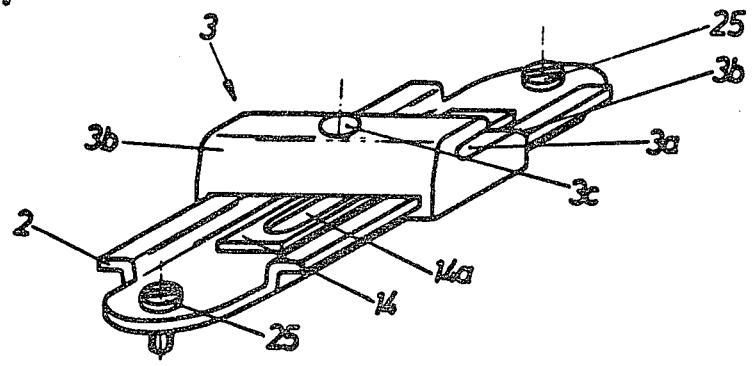
FIG. 1 is a perspective view of an inventive locking element.

The ski binding includes a front jaw which is secured to the ski 1 and is not illustrated in the drawings. As one can see from FIGS. 2 to 5, 9 and 10, a safety heel ski binding suitable for cross-country skiing is arranged on a ski 1. The heel binding includes a cross-country plate 9 which is pivotal about a not illustrated axis which extends transversely with respect to the longitudinal axis of the ski. Such a mounting is shown for example in Austrian Patent No. 343 522 or in the corresponding U.S. Pat. No. 4,088,342. A heel holder 100 is mounted on and adjacent the rear end of the plate 9, which rear end can be locked to the ski 1. More specifically, the heel holder 100 has a bearing block 17 which is fixedly connected to the cross-country plate 9 and which can also be constructed in one piece with the cross-country plate 9. The heel holder 100 includes a sole engaging piece 28 on which is mounted a down-holding member 8 with a stepping spur, all of which is pivotal about a horizontal axis which extends transversely with respect to the longitudinal axis of the ski and which serves to receive a release mechanism (not illustrated), which, however, will not be discussed in detail, since it is not the subject matter of the present invention.

Figure 8:
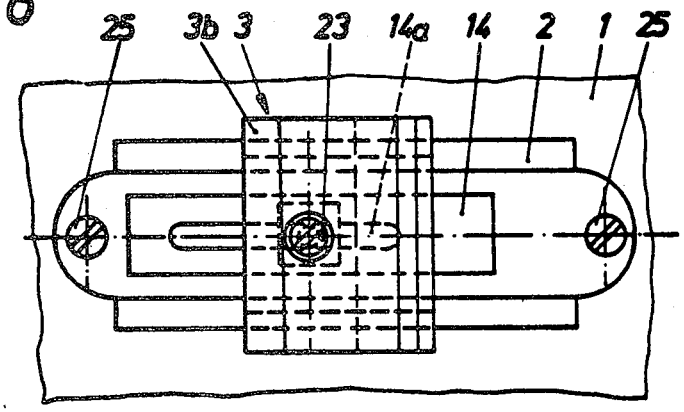
Figure 9:
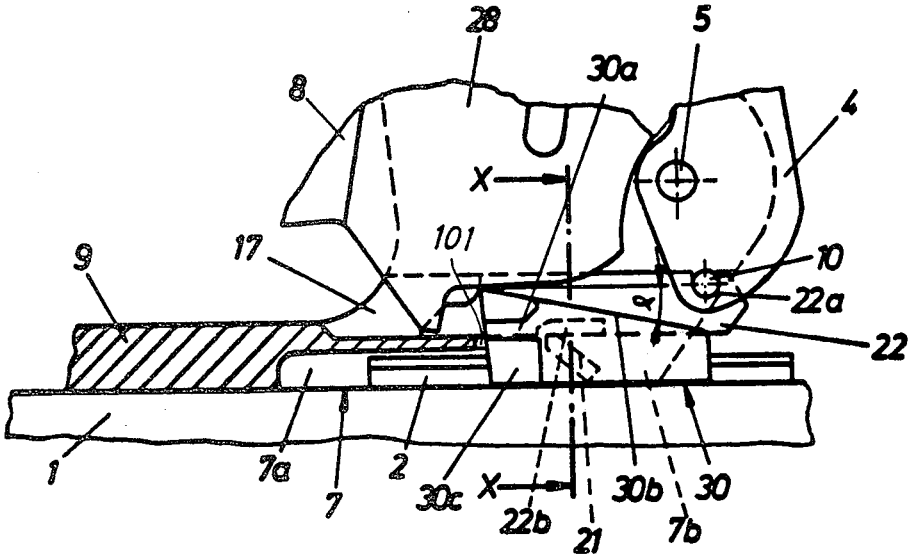
Figure 13:
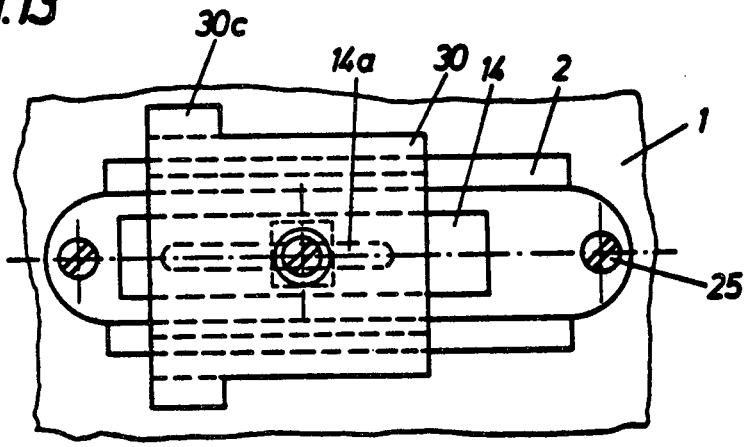

An elongated rail 2 (FIG. 1, also FIGS. 8 and 13) is secured to the ski 1 at each of its two opposite ends by means of one screw 25 located at the region below the heel holder on the ski 1. A locking element or slide piece 3, 30 is movably mounted onto the rail 2 and is movable in a direction parallel to the longitudinal axis of the ski 1. The locking element or slide piece 3, 30 has lateral bent sections thereon which grip around corresponding guide members on the rail. The guide members extend parallel to the longitudinal axis of the ski. The movement of the slide piece 3, 30 is limited to a specific region on the rail 2 and will be discussed in greater detail below.

In the downhill skiing position of the cross-country binding, the slide piece 3, 30 nad the rail 2 are positioned in a channel 7 in the bottom of the cross-country plate 9. The channel 7 is arranged symmetrically with respect to the longitudinal axis of the ski 1 and defines both a receiving section 7*a* for the rail 2 and a receiving section 7*b* for the slide piece 3, 30, which receiving section 7*b* includes an opening 101 which extends through the cross-country plate 9.

Figure 6:
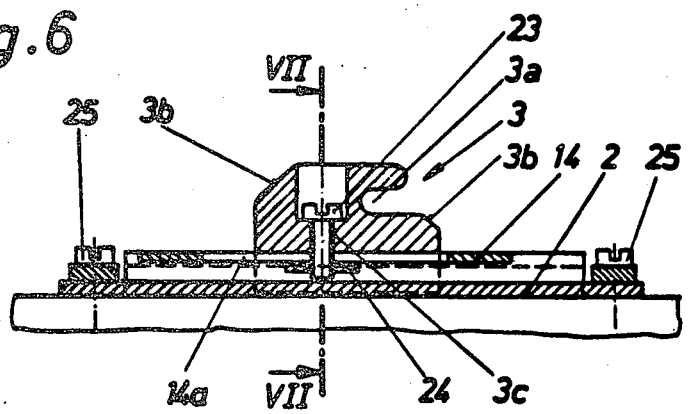
FIGS. 6 to 8 illustrate the inventive locking element, wherein specifically.
Figure 7:
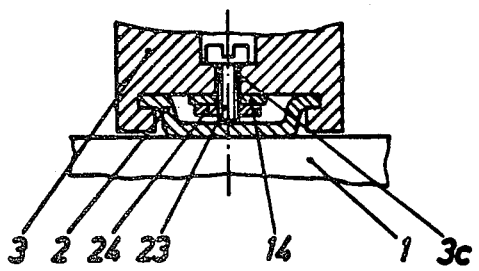
Figure 11:
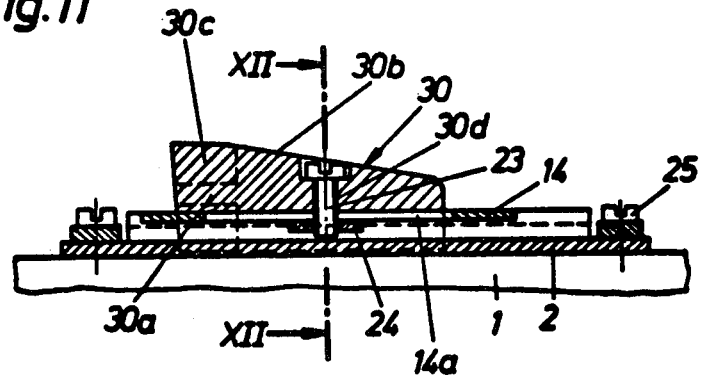
FIGS. 11 to 13 illustrate an inventive locking element, wherein specifically.
Figure 12:
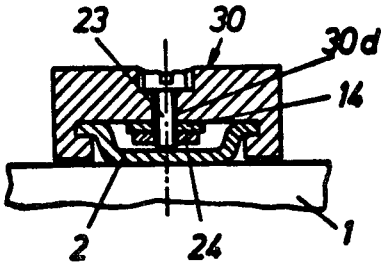

The slide piece 3, 30 is movably guided on the rail 2 as stated above over a specific region, is prevented from sliding off from same and is adjustable in the longitudinal direction of the rail 2 for purposes of adjusting the cross-country binding to different length ski shoes. As can be seen from FIGS. 6 and 11, the screws 25 which are screwed into the opposite end regions of the rail 2 prevent an undesired sliding of the slide piece 3, 30 off from the rail 2. A bent section on the rail 2 (not illustrated) can also accomplish the same stop objective as the screws.

As can be seen from FIGS. 6 to 8 and 11 to 13, the slide piece 3, 30 has an opening 3*c*, 30*d* which extends perpendicularly to the upper side of the ski 1 and into which is received a screw 23. The screw 23 is threadedly engaged with a small rectangularly shaped stop plate 14, located on the underside of the slide piece 3, 30. For this purpose, the screw 23 is secured to the small stop plate 14 by a nut 24. The screw 23 extends through an elongated slotted hole 14*a*, the elongation of which extends parallel to the longitudinal axis of the ski, in the substantially rectangularly shaped stop plate 14. Further, the rail, the slide piece and the slot are all oriented symmetrically to the longitudinal axis of the ski. The slotted hole 14*a* is constructed along the centerline of the small stop plate 14 and approximately over half of its length. The small stop plate 14 permits the slide piece 3, 30 to carry out a longitudinal movement along the rail 2 over a specific region, the dimension of which will yet be discussed in greater detail. The slotted hole 14*a* of the small stop plate 14 permits a longitudinal adjustment of the slide piece 3, 30, relative to the ski-fixed rail 2 over the entire length thereof. In the downhill skiing position of the safety ski binding, the slide piece 3, 30 together with the small stop plate 14 is moved in a direction toward the tip of the ski until the small plate 14 engages either a bent stop section on the rail 2 or the screw 25 closest to the tip of the ski. The safety ski binding is thereafter adjusted to a certain ski shoe length. If the safety ski binding is to be adjusted to a different ski shoe length, the cross-country plate 9 is shortened or extended by means of an adjusting mechanism which is not essential to the invention and is therefore not illustrated. Such an adjusting mechanism is shown for example in Austrian Patent No. 355 473. During this adjustment, the screw 23 is loosened and the slide piece 3, 30 along with the screw 23 is permitted to move in the slotted hole 14*a* of the small atop plate 14, whereby the small stop plate 14 is permitted to remain engaged with the screw 25 closest the tip of the ski, until the slide piece 3, 30 is properly reoriented relative to or adjusted to the new position of the heel holder.

The development of the guide piece 3 according to FIGS. 1 to 8 is best taken from FIG. 1. The slide locking elements or piece 3 is designed substantially as a square-shaped member (see also the top view thereof in FIG. 3, has a groove 3*a* extending over the entire width thereof and in a plane parallel to the upper side of the ski and opens outwardly in a direction toward the tail of the ski. Furthermore the slide piece 3 is sloped or rounded off as at 3*b* on its top surfaces facing both the tip of the ski and the tail of the ski.

The two edge areas of the opening 101 in the receiving section 7*b* of the channel 7 namely, the front and trailing edges, are provided with slide surfaces 21, the inclination of which relative to the upper side of the cross-country plate 9 corresponds approximately with the inclination of the sloped surfaces 3*b* on the slide piece 3 relative to the upper side of the rail 2.

A release lever 4 is pivotally supported on an axle 5 on the bearing block 17 in the first exemplary embodiment (FIGS. 2 to 4), which release lever 4 is provided for the arbitrary opening of the heel holder in a manner not illustrated. The release lever 4 is arranged between two upstanding sidewalls on the bearing block 17 and is a two-arm lever. The lever arm 4A of which projects above the sidewalls of the bearing block 17 serves as a handle to facilitate the manual movement of the release lever 4. The release lever 4 carries at the end thereof remote from the handle 4A a second lever arm 4B having a bolt 10 therein which is received in two laterally aligned locking recesses 20*a* of a slide member 20. The slide member 20 consists substantially of two laterally spaced holding parts 20*b*, which are arranged parallel to one another and which are coupled to one another by a pin 20*c*. The holding parts 20*b* of the slide member 20 are movably guided on guide shoulders 7*d* of the lateral boundary surfaces of the receiving section 7*b* of the channel 7, which boundary surfaces extend parallel with respect to the longitudinal axis of the ski.

The two locking recesses 20*a* open upwardly (in a direction away from the upper side of the ski) and are located on the upper edges of the holding parts 20*b*. The pin 20*c* is received in the groove 3*a* of the slide piece 3 and connects the holding parts 20*b* of the slide member 20 in the area below the locking recesses 20*a*.

Figure 4:
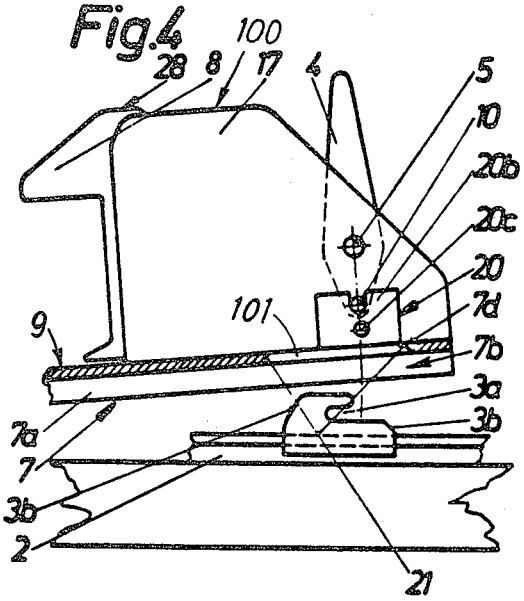

The operation of this inventive locking mechanism is very simple. Starting out from a position of the safety ski binding as it is illustrated in FIG. 4, which figure shows the unlocked position as it exists for example during cross-country skiing, the cross-country plate 9 is swivelled at the heel in a downward direction toward the upper side of the ski and the slide surfaces 21 engage the slide piece 3 and move it on the rail 2 into its correct position relative to the pin 20*c* of the slide member 20. As soon as the slide piece 3 has been received in the opening 101 in the receiving section 7*b* of the channel 7 of the cross-country plate 9, as by a swivelling of the release lever 4 in a clockwise direction, a reception of the pin 20*c* of the slide member 20 in the groove 3*a* in the slide piece 3 occurs. This operation does not require the skier to step out of the cross-country binding. The path of movement on the rail 2 which is available to the slide piece 3 through the longitudinal dimension of the small stop plate 14, permits the slide piece 3 to carry out a longitudinal movement at least over an area determined by a thrust balance which is built into the binding (not illustrated).

Figure 5:
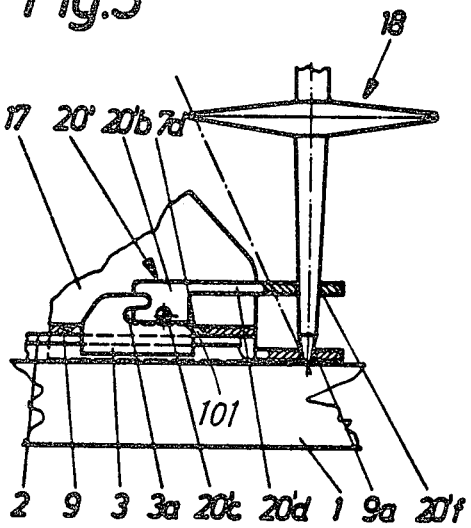
FIG. 5 is a side view, partially in cross section, of a second exemplary embodiment of an inventive locking mechanism.

FIG. 5 illustrates a further exemplary embodiment of the inventive locking mechanism. The slide piece 3 is constructed just like in the abovedescribed exemplary embodiment. Also its guide structure on the ski-fixed rail 2, and its longitudinal adjustment capabilities on the rail correspond with the first exemplary embodiment. In addition, the construction of the channel 7 also corresponds with the first exemplary embodiment. The slide member 20' also has two laterally spaced holding parts 20'*b* arranged parallel to one another, are coupled together by a pin 20'c and are movably guided on the guide shoulders 7d of the channel 7. Furthermore the two holding parts 20'b are connected on their upper edges remote from the cross-country plate 9 by a web having a projection member 20'd which projects over the heel holder in a direction toward the tail of the ski. Also the cross-country plate 9 extends beyond the confines of the heel holder in a direction toward the tail of the ski. An opening 20'f extends through the projection member 20'd on the slide member 20'. The tip of a ski pole 18 is inserted through the opening 20'f in the projection 20'd and is received in an axially aligned recess 9a in the region of the cross-country plate 9 located below the projection member. A swivelling of the ski pole 18 particularly the upper end thereof in a direction toward the tip of the ski causes a movement of the slide member 20' and the receipt of the pin 20'c of the slide member 20' in the groove 3a of the slide piece 3. A swivelling of the ski pole 18 in a direction toward the tail of the ski causes a disengagement of the pin 20'c from the groove 3a to permit the cross-country plate 9 to be lifted off from the ski 1 and swung into its position for cross-country skiing.

Figure 9A:
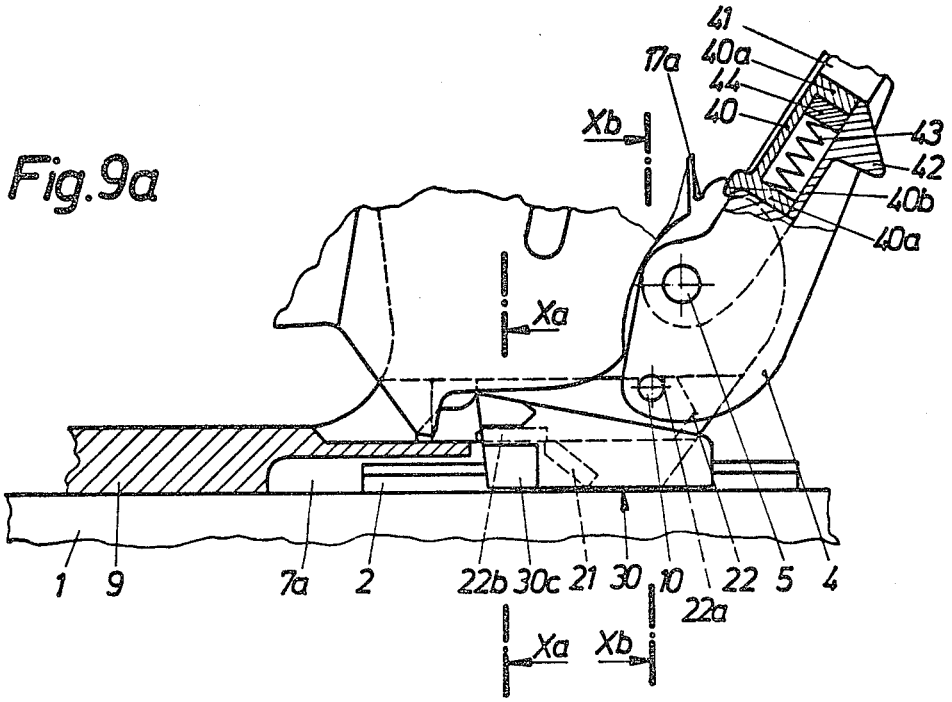

Also in the exemplary embodiment according to FIGS. 9 to 13, the slide piece 30 is a substantially square-shaped, flat member, the upper side of which has a gradually sloped surface 30b which is inclined downwardly in a direction toward the tail of the ski. When the cross-country plate 9 is placed on the upper side of the ski, the lower region of the substantially closed sole engaging piece 28 is just slightly above the sloped surface 30b of the slide piece 30. The angle $\alpha$ which is defined by the partial area of the underside of the sole engaging piece, which area exists above the tail end region of the slide piece 30 and which tail end area is positioned higher relative to the upper side of the ski and the sloped surface 30b, is 15°. At the end of the slide piece 30 remote from the tail of the ski, as can be seen from FIGS. 9a and 10a there is provided on both sides a guide part 30c which is laterally offset from the remaining side area, which guide part has a rabbet 30a which divides the guide part and which extends parallel with respect to the upper side of the ski and a backwall which terminates flush with the remaining side area of the slide piece 30. The upper edge of each guide part 20c facing the end of the ski is constructed round.

Figure 2:
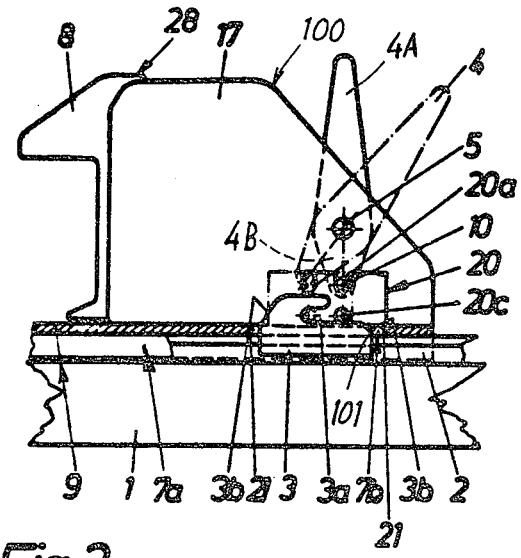
FIGS. 2 to 4 illustrate a first exemplary embodiment of an inventive locking mechanism wherein specifically.
Figure 3:
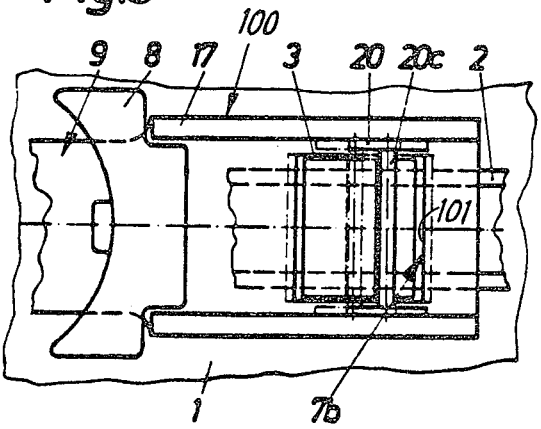
Figure 10:
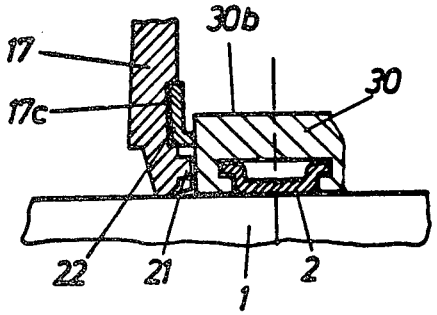
Figure 10A:
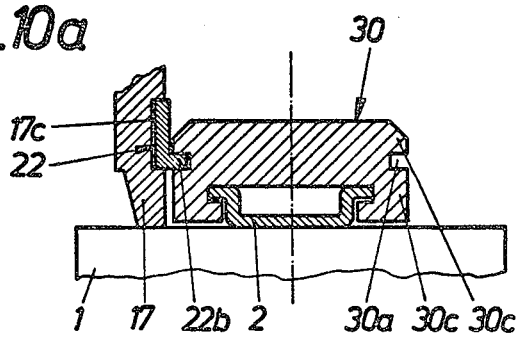
Figure 10B:
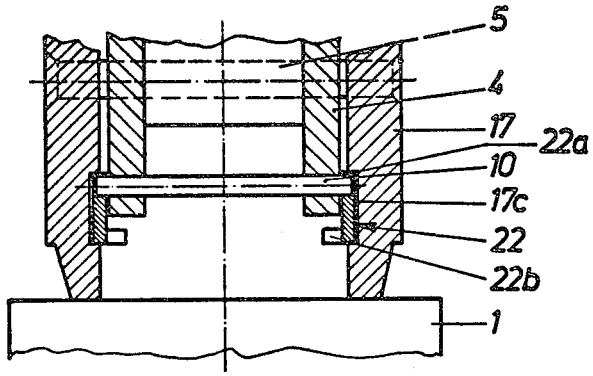

Also in this exemplary embodiment, the slide surfaces 21, which are provided on the two lateral edges of the receiving sections 7b of the channel 7 at an acute angle with respect to the upper side of the cross-country plate, which edges extend parallel with respect to the longitudinal axis of the ski, engage during a setting down of the cross-country plate onto the ski 1 the rounded edges of the guide parts 30c of the slide piece 30, which slide surfaces 21 center the slide piece 30 moving it along the rail 2 to the correct position. In operation, the locking mechanism serves in this exemplary embodiment as a release lever 4, which like in the exemplary embodiment according to FIGS. 2 to 4, is pivotally connected to the bearing block 17 by the axle 5, is arranged within the sidewalls of the bearing block 17 and, viewed in the side view, is designed as a two-arm lever. One of the lever arms which projects over the bearing block 17 serves as a handle for swivelling the release lever 4. The release lever 4 carries a bolt 10 at the end of the second lever arm, which bolt is received in two laterally aligned locking recesses 22a of a two-part slide member 22 (FIGS. 10a, 10b). The two-part slide member 22 is movably guided in guide grooves 17c which are located on the two inner walls of the bearing block 17, which inner walls extend parallel with respect to the longitudinal axis of the ski and normally with respect to the upper side of the ski. The two guide grooves 17c and thus the two-part slide member 22 are symmetrically arranged with respect to the longitudinal axis of the ski 1. The two locking recesses 22a are constructed on the upper edges of the two-part slide member 22 and are open upwardly (in a direction away from the upper side of the ski). Each slide member part 22 carries an inwardly (in a direction facing the center of the ski) extending locking arm 22b. Each locking arm 22b can get engaged with and disengaged from the rabbet 30a on the slide piece 30 facing the locking arm 22b.

Also this exemplary embodiment is distinguished through a simple operation. When the cross-country plate 9 is set down onto the upper side of the ski, the slide surfaces 21 grab the slide piece 30 and move same on the rail 2 into its correct position relative to the two slide member parts 22. As soon as the slide piece 30 is received in the opening in the receiving point 7b of the channel 7 of the cross-country plate 9, as by swivelling the release lever 4 in a clockwise direction, the two slide member parts 22 are moved by the bolt 10, so that their locking arms 22b slide in the rabbets 30a of the slide piece 30. This operation does not require the skier to step out of the cross-country binding. The path of movement on the rail 2, which is available to the slide piece 20 due to the longitudinal dimension of the small stop plate 14, permits the slide piece 30 to carry out of a longitudinal movement at least over the region determined by a thrust balance mechanism (not illustrated) built into the binding and permits the slide piece 30 to carry out a longitudinal movement when the ski is flexed during skiing through depressions. A locking of the release lever 4 on the bearing block 17 prevents on unintended movement of the slide member 22 and thus a release of the engagement of the locking arms 22b in the grooves 30b. For this purpose the lever arm 4A of the release lever 4 is provided with a slide member 40 having two projection members 40d which are moveably guided in an opening 41 of the release lever 4. The opening 41 extends parallel with respect to the longitudinal extension of the release lever 4. Remote from the bearing block 17 the slide member 40 carries an operating lever 42 which extends from the opening 41 outside the release lever 4. A spring 43 is arranged between the slide member 40 and the operating member 42, one end of the spring 43 abuts the projection member 40a being located at the bottom of the opening 41, the other end of the spring 43 abuts a part 44 of the release lever 4, which part 44 is provided underneath the upper projection member 40a. The slide member 40 has a locking arm 40b which extends perpendicular to the longitudinal direction of the ski and parallel with respect to the surface of the ski. The locking arm 40b can get engaged with and disengaged from notches 17a,17b provided on each side wall of the bearing block 17. When the locking arm 40b is engaged with the notches 17a the release lever 4 is locked in the position for cross country skiing, by moving the slide member 40 by means of the operating lever 42 against the force of the spring 43 in an upword direction the locking arm 40b gets disengaged from the notches 17a. By swivelling the release lever 4 the two part slide member 22 gets engaged with the rabbets 30*a* on the slide piece 30, the binding is in the locked position for downhill skiing.

Aside from a simple operation, this inventive locking mechanism is primarily advantageous since snow and ice accumulations cannot at all occur in the area of the locking elements. During the up and down movement of the cross-country plate 9, which movement occurs constantly during the cross-country skiing, the sole engaging piece 28, which when the cross-country plate 9 sits on the upper side of the ski, is spaced slightly above the sloped surface 30*b* of the slide piece 30, presses possible snow accumulations, to the outside over the sloped surface 30*b* of the slide piece 30. Thus the area of the locking elements cannot ice up, the locking mechanism remains fully functional during all snow conditions.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A safety ski binding for use in cross-country skiing and downhill skiing, comprising:

a cross-country plate having a bearing block thereon adjacent the rear portion thereof to which a heel holder is supported;

locking means for facilitating a locking of at least the rear portion of said cross-country plate to said ski, said locking means having a locking element which, in the locked position of said cross-country plate, is received in an opening through said cross-country plate, said locking means further including a slide member movably supported on said cross-country plate and being movable between a first position operatively engaging said locking element to lock said cross-country plate to said ski and a second position free of engagement with said locking element to unlock said cross-country plate from said ski, said locking means further including an elongated rail fixed to said ski and means on said rail and said locking element for movably guiding said locking element along the length of said rail; and lever means for effecting a movement of said slide member between said first and second positions.

2. The safety ski binding according to claim 1, wherein said locking element has means defining a groove thereon which extends parallel with respect to said upper surface of said ski and above said cross-country plate when said cross-country plate is in the position parallel to said upper surface of said ski and opens outwardly in a direction facing toward the tail of said ski, and wherein said slide member has a pin thereon movable into and out of said groove when said cross-country plate is oriented parallel to said upper surface of said ski.

3. The safety ski binding according to claim 2, wherein said slide member is comprised of two horizontally and laterally spaced holding parts secured together by said pin, each of said holding parts slidably engaging said cross-country plate along lateral edges of said opening through said cross-country plate and which extend parallel to the longitudinal axis of said cross-country plate.

4. The safety ski binding according to claim 2, wherein said lever is a two-arm release lever which is pivotally supported on said bearing block and is provided for the arbitrary opening and closing of said heel holder, one arm of said lever projecting into the region of movement of said slide member and having a bolt thereon, said bolt engaging a locking recess on each holding part of said slide member.

5. The safety ski binding according to claim 11, wherein stop means are provided at the opposite ends of said rail, and wherein on the underside of said locking element there is held a small stop plate which engages selected ones of said stop means and permit a limited longitudinal movement of said locking element along the length of said rail.

6. The safety ski binding according to claim 5, wherein said locking element has a bore therethrough into which a screw is inserted, said screw extending through a slotted hole in said small stop plate and effects said holding of said stop plate to said locking element, said slotted hole being elongated longitudinally of said rail, whereby the position of said locking element is adjustable relative to said small stop plate and/or relative to said rail over the entire length of said slotted hole.

7. The safety ski binding according to claim 6, wherein said screw has a nut thereon which effects a clamping of said small stop plate between said nut and said locking element.

8. The safety ski binding according to claim 1, wherein at least two slide surfaces which face one another are provided along opposing front and trailing edges of said opening of said cross-country plate, and wherein sloped surfaces are provided on said locking element and engage said slide surfaces during a movement of said cross-country plate in a direction toward said upper surface of said ski.

9. The safety ski binding according to claim 1, wherein said lever means is a ski pole, and wherein said slide member includes an extension having means defining a hole therethrough which is adapted to receive the ground engaging tip portion of said ski pole, whereby a movement of said ski pole will effect a movement of said slide member between said first and second positions.

10. The safety ski binding according to claim 1, wherein locking element has a guide part which is offset from the remaining side area, on each of its two side areas which extend parallel with respect to the longitudinal axis of the ski, each guide part having a rabbet which divides it and extends parallel with respect to said upper surface of said ski, with which rabbets can engage and from which rabbets can disengage locking arms provided on said locking elements, and wherein said locking element is constructed in two parts, each being movably guided in guide grooves which extend parallel with respect to the upper side of said cross-country plate and are provided on two inner walls of said bearing block.

11. The safety ski binding according to claim 1, wherein the upper side of said locking element is constructed as a sloped surface which drops off in a direction toward the tail of said ski, over which sloped surface, in cooperation with a portion of said heel holder and during cross-country skiing, snow and ice accumulations will be guided away from said locking means.

12. The safety ski binding according to claim 11, wherein said heel holder includes a substantially closed sole engaging piece which is supported on said bearing block, the lower region of which piece faces said upper surface of said ski when in the downhill skiing position of said cross-country plate, and when viewed from the tail end of said locking element, extends at least up to between one half and two thirds of said sloped surface on said locking element.

13. The safety ski binding according to claim 12, wherein an angle ($\alpha$) which exists between said sloped surface and at least the partial area of the underside of the sole engaging piece, which partial area lies above the end area of said locking element and which end area lies higher relative to said upper surface of said ski, is approximately 10° to 30°.

14. A safety ski binding for use in cross-country skiing and downhill skiing, comprising:

a cross-country plate movably mounted on a ski into and out of parallel relation with the upper surface thereof and having a bearing block thereon adjacent the rear portion thereof to which a heel holder and a pivotally supported lever are supported;

locking means for facilitating a locking of at least the rear portion of said cross-country plate to said ski, said locking means having a locking element which is arranged on said ski and, in the locked position of said cross-country plate, is received in an opening through said cross-country plate, said locking means further including a slide member movably supported on said cross-country plate and being movable between a first position operatively engaging said locking element to lock said cross-country plate to said ski and a second position free of engagement with said locking element to unlock said cross-country plate from said ski, said locking means further including means on said slide member operatively engagable with said lever whereby manual pivoting manipulation of said pivotal lever will effect a movement of said slide member between said first and second positions.

* * * * *

UNITED STATES PATENT AND TRADEMARK OFFICE

CERTIFICATE OF CORRECTION

PATENT NO. : 4 436 322

DATED : March 13, 1984

INVENTOR(S) : Heinz Wittmann et al

It is certified that error appears in the above-identified patent and that said Letters Patent is hereby corrected as shown below:

Column 10, line 1; change "2" to ---3---.

Column 10, line 9; change "11" to ---1---.

Signed and Sealed this

*Tenth* Day of *July 1984*

[SEAL]

*Attest:*

GERALD J. MOSSINGHOFF

*Attesting Officer*

*Commissioner of Patents and Trademarks*